US010654096B2

(12) United States Patent
Iguma et al.

(10) Patent No.: US 10,654,096 B2
(45) **Date of Patent: *May 19, 2020**

(54) MANUFACTURING METHOD FOR CYLINDER HEAD

(71) Applicant: TOYOTA JIDOSHA KABUSHIKI KAISHA, Toyota-shi, Aichi-ken (JP)

(72) Inventors: Hiroki Iguma, Shizuoka-ken (JP); Akio Kawaguchi, Shizuoka-ken (JP); Hideo Yamashita, Mishima (JP); Kazuaki Nishio, Nisshin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 443 days.

This patent is subject to a terminal disclaimer.

(21) Appl. No.: 15/364,882

(22) Filed: Nov. 30, 2016

(65) Prior Publication Data

US 2017/0209916 A1 Jul. 27, 2017

(30) Foreign Application Priority Data

Jan. 21, 2016 (JP) ..... 2016-010054

(51) Int. Cl.
*B21K 3/02* (2006.01)
*F02F 1/24* (2006.01)

(52) U.S. Cl.
CPC ..... *B21K 3/02* (2013.01); *F02F 1/24* (2013.01); *F02F 2001/249* (2013.01);
(Continued)

(58) Field of Classification Search
CPC ..... B23P 6/02; B21K 3/02; F02F 1/00; F02F 1/24; F02F 1/42; F02F 2200/00;
(Continued)

(56) References Cited

U.S. PATENT DOCUMENTS 3,318,281 A 5/1967 Plegat
3,607,381 A 9/1971 Fairbairn
(Continued)

FOREIGN PATENT DOCUMENTS

CA 2126538 A1 12/1995
CN 203270015 U 11/2013
(Continued)

OTHER PUBLICATIONS

United States Patent and Trademark Office, Non-Final Office Action issued to U.S. Appl. No. 15/363,007, dated Aug. 9, 2018, 16 pages.
(Continued)

*Primary Examiner* — Sarang Afzali
(74) *Attorney, Agent, or Firm* — Hunton Andrews Kurth LLP

(57) ABSTRACT

A manufacturing method for a cylinder head is described. A masking member is attached to a cylinder head material, which followed by a film formation step. The masking member comprises a mask portion to mask the matching surface with the cylinder block, mask portions to mask each of the openings of intake and exhaust ports and a mask portion to mask at least one narrow region sandwiched between openings of two adjacent port holes and has the shortest distance between opening edges of the two adjacent port holes. All Mask portions are coplanar and linked directly to each other.

8 Claims, 7 Drawing Sheets

(52) U.S. Cl.
CPC ..... *F02F 2200/00* (2013.01); *Y10T 29/49272* (2015.01); *Y10T 29/49982* (2015.01)

(58) Field of Classification Search
CPC ..... F02F 2200/06; F02F 2001/249; F02F 1/4285; Y10T 29/4927; Y10T 29/49272; Y10T 29/49982; Y10T 29/4998; C23C 4/01; C23C 4/12; C23C 4/11; C23C 4/10; C23C 4/18; C23C 4/129; C23C 4/134; C23C 4/137; C23C 24/04; F02B 77/00
See application file for complete search history.

(56) References Cited

U.S. PATENT DOCUMENTS

| | | | | |
|---|---|---|---|---|
| 4,031,268 | A | 6/1977 | Fairbairn | |
| 5,573,814 | A | 11/1996 | Donovan | |
| 3,017,591 | A | 1/2000 | Popoola et al. | |
| 3,060,117 | A | 5/2000 | Pergande et al. | |
| 6,925,981 | B2 | 8/2005 | Ibukuro et al. | |
| 7,032,560 | B2 | 4/2006 | Katou et al. | |
| 7,458,358 | B2 * | 12/2008 | Lineton | B23K 26/34 123/193.6 |
| 8,869,737 | B2 * | 10/2014 | Takahashi | B05B 13/0618 118/301 |
| 8,985,049 | B2 | 3/2015 | Bellino et al. | |
| 9,353,702 | B2 * | 5/2016 | Sharp | F02F 7/0095 |
| 10,138,840 | B2 * | 11/2018 | Ruona | F02F 3/10 |
| 10,252,323 | B2 * | 4/2019 | Iguma | B21K 3/02 |

FOREIGN PATENT DOCUMENTS

| | | | |
|---|---|---|---|
| DE | 102008028959 | A1 | 1/2009 |
| JP | H10-220277 | A | 8/1998 |
| JP | H11172403 | A | 6/1999 |
| JP | 2002-054442 | A | 2/2002 |
| JP | 2012-159059 | A | 8/2012 |
| JP | 2014-020301 | A | 2/2014 |
| JP | 2014-156790 | A | 8/2014 |

OTHER PUBLICATIONS

United States Patent and Trademark Office, Notice of Allowance issued to U.S. Appl. No. 15/363,007 dated Nov. 26, 2018, 5 pages.

* cited by examiner

MANUFACTURING METHOD FOR CYLINDER HEAD

CROSS-REFERENCE TO RELATED APPLICATION

The present application claims priority to Japanese Patent Application No. 2016-010054 filed on Jan. 21, 2016, which is incorporated herein by reference in its entirety.

BACKGROUND

Technical Field

The present application relates to a manufacturing method for a cylinder head, and more particularly, to the manufacturing method for a cylinder head with a surface on which a heat shield film (a heat insulation film) is formed.

Background Art

A combustion chamber of an engine is generally defined as surrounded space by a boa surface of a cylinder block, a top surface of a piston stored inside the boa surface, a bottom surface of a cylinder head, a bottom surface of an umbrella part of an intake valve which is disposed at an intake port formed in the cylinder head, and bottom surface of an umbrella part of an exhaust valve which is disposed at an exhaust port formed in the cylinder head. In such a combustion chamber, a heat shield film may be formed on the top face of the piston and the like that constitute walls of the combustion chamber in order to reduce a cooling loss within an engine.

For example, JP2012-159059A discloses an art in which an anode oxidation film (specifically an alumite film) is formed as a heat shield film on a bottom surface of a cylinder head that constitute walls of a combustion chamber of a spark ignition type engine. The publication mentioned above also discloses that the bottom surface has holes corresponding to an intake port, an exhaust port and a spark plug, which are preferably masked during anodizing treatment of the bottom surface.

JP2002-054442A discloses an art in which heat shield layers made from materials such as ceramic, stainless, titanium or the like are formed on a portion of a bottom surface of a cylinder head near to an intake valve and a bottom of an umbrella portion of the intake valve, both of which constitute walls of a combustion chamber of a spark ignition type engine. The publication also discloses that the heat shielding layer of the cylinder head may be formed by casting the cylinder head and then thermal spraying on the bottom surface of the cylinder head.

LIST OF RELATED ART

Following is a list of patent documents which the applicant has noticed as related arts of the present application.

Patent Literature 1: JP2012-159059A

Patent Literature 2: JP2002-054442A

SUMMARY

Although JP2002-05442A does not mention about that, in order to form the heat shield film by thermal spraying, it is necessary to mask a non-film formation region within a wall surface of an engine combustion chamber. Such mask is generally used in a film forming method represented by thermal spraying and cold spraying in which film material particles are blown to a film forming surface.

The masking of the non-film formation region is generally performed, for example, to attach an appropriate masking member on a cylinder head. If a masking member in which a masking portion to mask a matching surface of a cylinder head with a cylinder block (hereinafter also referred to as "the matching surface with the cylinder block") is combined with a masking portion to mask the non-film formation region is used, it helps to simplify attach and detach work of the masking member thereby productivity of the cylinder head is improved.

However, total area of the wall surface has been reduced in association with miniaturization of the engine in these days. Within the wall surface, since a region sandwiched between openings of two adjacent ports is originally narrow, the narrow region is especially affected by the miniaturization of the engine. For that reason, even if a heat shield film is formed on the narrow region by using the masking member mentioned above, there is a risk that the heat shield film on the narrow region is peeled together with the masking member during the detachment thereof.

In view of at least one of above described problems, an object of the present application is to suppress an occurrence of peeling of a heat shield film during detachment of a masking member which is used to form the heat shield film by spraying film material particles and detached after the formation of the heat shield film.

The present application provides a manufacturing method for a cylinder head comprises a preparation step, an attaching step, a film formation step and a detaching step. The preparation step is a step for preparing a cylinder head material having in the same plane a matching surface with a cylinder block and a wall surface of an engine combustion chamber, wherein the wall surface has at least three port holes that include an intake port and an exhaust port. The attaching step is a step for attaching the cylinder head material to a masking member that is configured to mask a non-film formation region of the wall surface and the matching surface with the cylinder block. The film formation step is a step for, after the attachment of the masking member, injecting film material particles onto the matching surface with the cylinder block to form a heat shield film. The detaching step is a step for detaching the masking member from the cylinder head material after the formation of the heat shield film.

The masking member comprises a matching surface mask portion, port hole mask portions and a between openings mask portion. The matching surface mask portion is configured to mask the matching surface with the cylinder block. The port hole mask portions are configured to link to the matching surface mask portion directly and to mask openings of the port holes. The between openings mask portion is configured to mask at least one narrow region which is a sandwiched region between openings of two adjacent port holes and also is the shortest distance region between opening edges of the adjacent port holes, and is configured to link directly to both of the port hole mask portions that mask the openings of the adjacent port holes, respectively.

In the present application, the film material particles may be sprayed in the film formation step onto the entire region of the wall surface in a direction oppose to the matching surface with the cylinder block.

In the present application, when the wall surface further includes a part hole that is a hole for housing an engine-related part, the between openings mask portion may also be configured to mask an opening of the part hole. In this case, the between openings mask portion may be configured to mask a region including the opening of the part hole and one of the at least one narrow region which is the closest to the opening of the part hole.

In the present application, when the at least one narrow region comprises a plurality of narrow regions which are divided into two groups in accordance with the shortest distance between opening edges of the adjacent port holes, the between openings mask portion may be configured to mask at least one region that is divided into a short distance group.

In the present application, when the wall surface includes at least two adjacent intake ports, the between openings mask portion may be configured to mask at least one region within the at least one narrow region, the at least one region is a sandwiched region between the openings of the adjacent intake ports.

In the present application, when the wall surface includes at least two adjacent exhaust ports, the between openings mask portion may be configured to mask at least one region within the at least one narrow region, the at least one region is a sandwiched region between the openings of the adjacent exhaust ports.

In the present application, the between openings mask portion may be configured to mask all of the at least one narrow region.

According to the present application, the at least one narrow region can be masked by the between openings mask portion. That is, film formation on the at least one narrow region where the peeling of the heat shield film tends to take place can be avoided by the between openings mask portion. Therefore, the present application suppresses an occurrence of the peeling of the heat shield film during detachment of the masking member and thus, a high-quality heat shield film can be obtained.

DETAILED DESCRIPTION

Figure 1:
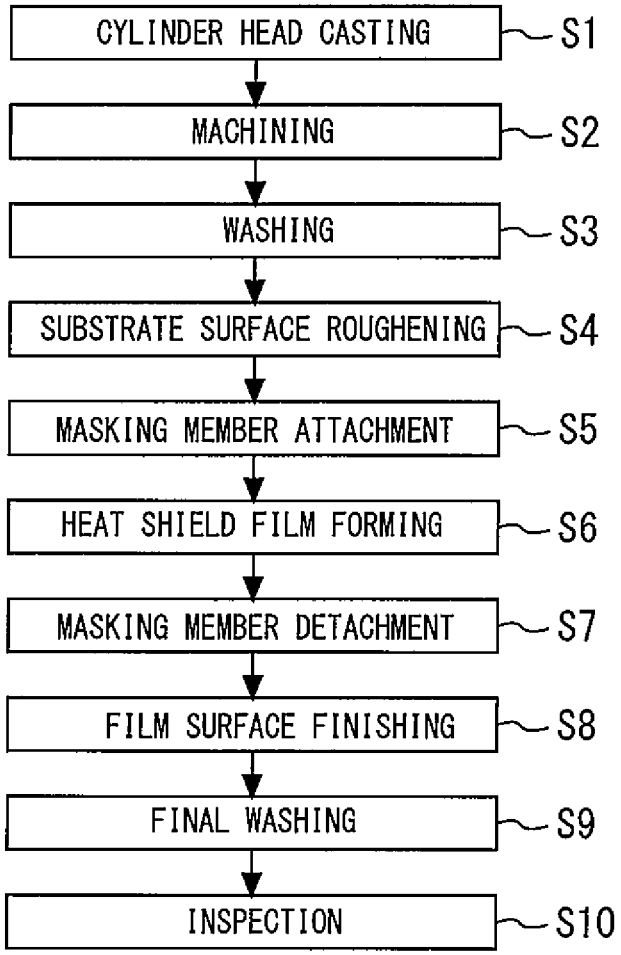
FIG. 1 is a diagram for describing a flow of a manufacturing method of a cylinder head of an embodiment of the present application.

Embodiments of the present application are described hereunder referring to figures. Note that elements that are common to the respective drawings are denoted by the same reference characters and a duplicate description thereof is omitted. Further, the present application is not limited to the embodiments described hereunder.

First Embodiment

A first embodiment of the present application is described with reference to FIGS. 1 to 8.

Manufacturing Method for a Cylinder Head

FIG. 1 is a diagram for describing a flow of a manufacturing method of a cylinder head (specifically, a cylinder head for a compression self-ignition type engine) of an embodiment of the present application. In this embodiment, at first, a casting of a cylinder head is carried out (step S1). In the step S1, a plurality of cores to form an inner spatial area of the cylinder head such as an intake port to attach an intake valve, an exhaust port to attach an exhaust valve and a water jacket are installed to predetermined positions of a plurality of dies to form an outer shape of the cylinder head. Then a base material (e.g., aluminum alloy) of the cylinder head is poured into the dies to be molded. Then a casting product (hereinafter simply referred to as "cylinder head material") is removed from the dies while the cores are crushed to remove.

Following the step S1, a machining of the cylinder head material is carried out (step S2). In the step S2, specifically, a hole for housing an injector (hereinafter referred to as an "injector hole"), holes for housing bolts to install the cylinder head into a cylinder block (hereinafter referred to as "bolt holes") and valve guides for supporting the intake valve and the exhaust valve are formed with a drill.

Figure 2:
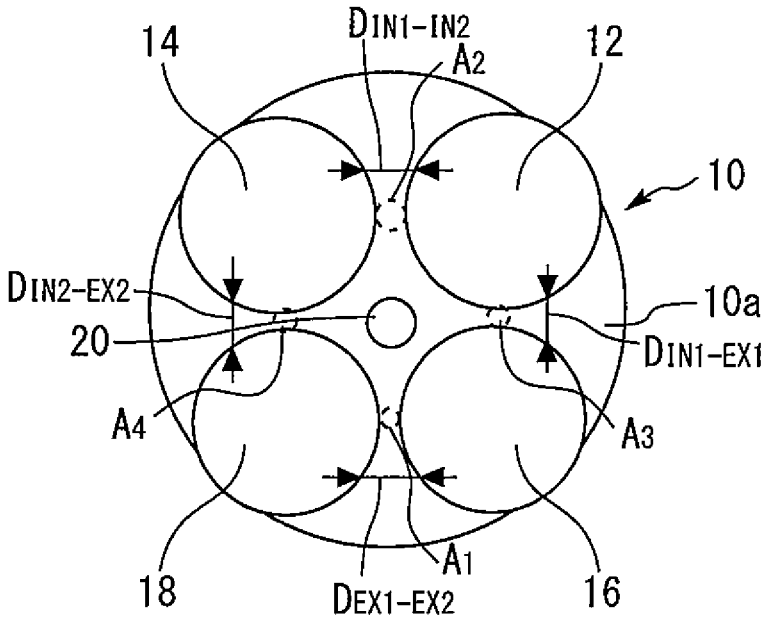
FIG. 2 is a schematic diagram for showing a region, after a machining of a step S2 of FIG. 1, to which a wall surface of a combustion chamber corresponds within a surface of a casting product of a cylinder head.

FIG. 2 is a schematic diagram for showing a region, after the machining of the step S2, to which a wall surface of a combustion chamber corresponds within the surface of the cylinder head material. As shown in FIG. 2, the injector hole 20 is formed on the central part of the cylinder head material 10 (more properly, the central part of a wall surface 10*a* of the surface of the cylinder head material 10). The intake ports 12 and 14 and the exhaust ports 16 and 18 are formed so as to surround this injector hole 20. The bolt holes are formed on the matching surface with the cylinder block located outside of the wall surface 10*a* shown in FIG. 2.

Following the step S2, a washing of the machined cylinder head material is carried out (step S3). This step is carried out for the reason that if the cylinder head material contains foreign matters such as sand of the core occurred by the crush in the step S1 and cutting waste occurred by the machining in the step 2, the quality of a final product, i.e. an engine, will be declined. Another reason for the step S3 is to avoid an influence on a film formation in the step S6 described below. In the step S3, specifically, washings are injected to the intake port 12, the injector hole 20 and the like shown in FIG. 2 thereby foreign matters are removed therefrom.

Following the step S3, a roughening a predetermined region of the surface of the cylinder head material (substrate surface) is carried out (e.g., water jet, sandblast, laser material processing, and the like) (step S4). This step is carried out for the reason that if the roughness of the predetermined region is intentionally deteriorating, a coherence power of the heat shield film formed thereon is improved due to an anchor effect. Here, the predetermined region is comparable to a film formation region, in particular, the whole region of the wall surface 10*a* shown in FIG.

2. Note that if the film formation region is a part of the wall surface 10*a* (e.g. a part of the surface around the injector hole 20), the predetermined region shall be reduced.

Figure 3:
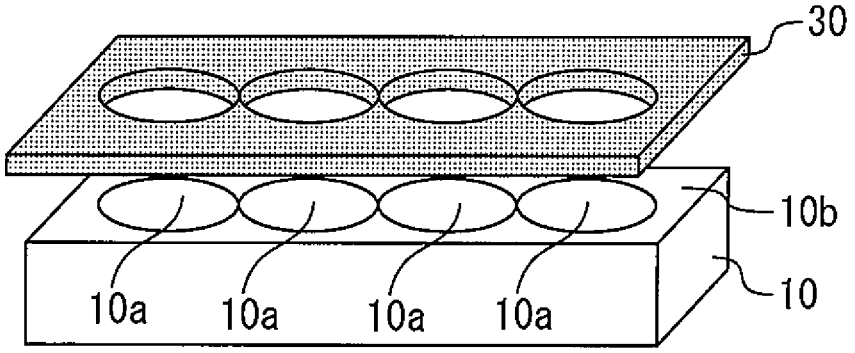
FIG. 3 is a diagram for describing a step S5 of FIG. 1.
Figure 4:
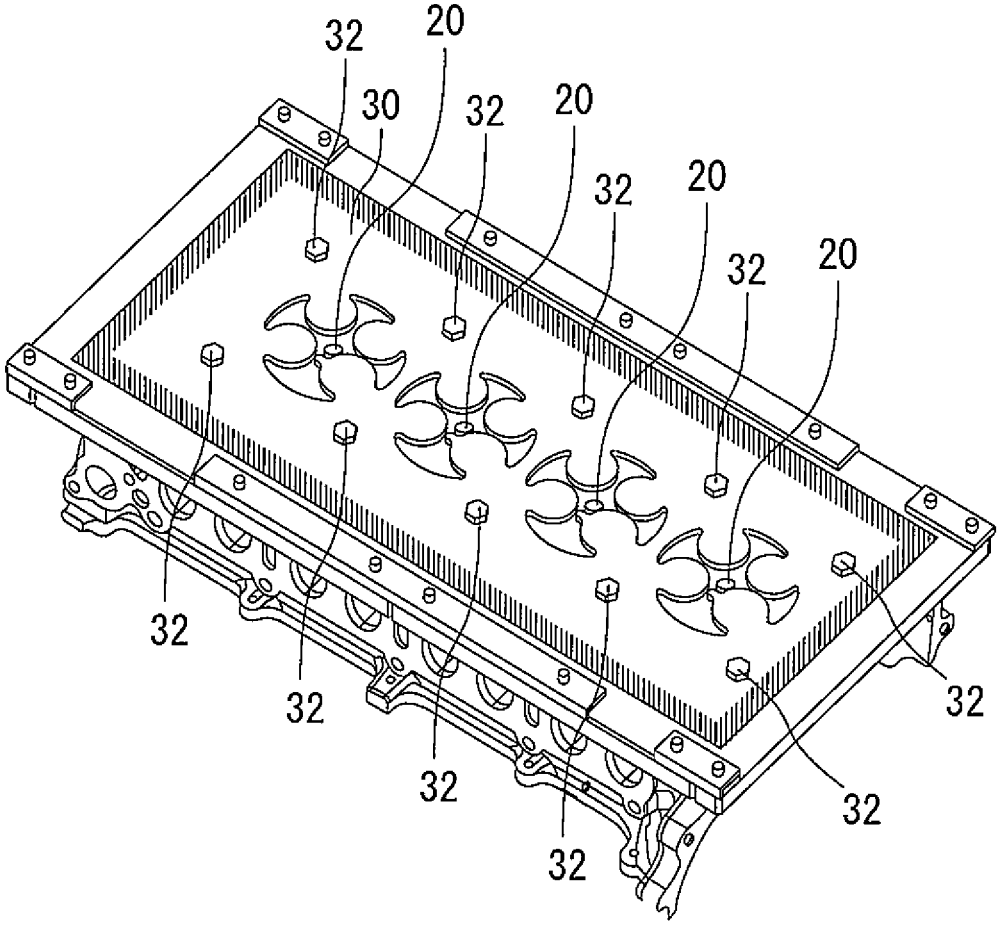
FIG. 4 is a diagram for describing a step S5 of FIG. 1.

Following the step S4, an attachment of the masking member is carried out (step S5). This step S5 is described with reference to FIG. 3 to FIG. 5. Note that the cylinder head material and the masking member are simplified in FIG. 3 for convenience of the explanation. As shown in FIG. 3, a plate-like masking member 30 is attached to the cylinder head material 10 in this step S5. FIG. 4 is a diagram for showing the cylinder head material 10 to which the masking member 30 is attached. A plurality of knock pins 32 are positioning pins which are inserted into the bolt holes through the masking member 30. By the positioning pins, the masking member 30 is positioned at a predetermined position within the surface of the cylinder head material 10 (more properly, the matching surface with the cylinder block 10*b* shown in FIG. 3) and the masking member 30 is appressed to the surface of the cylinder head material 10.

Figure 5:
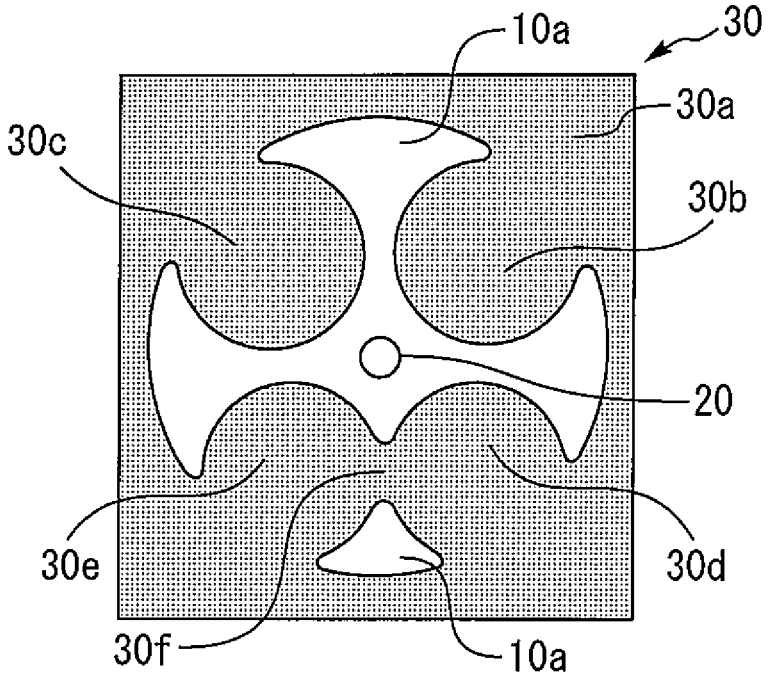
FIG. 5 is a diagram for showing a part of a masking member which is attached to the casting product of the cylinder head.

FIG. 5 is a diagram for showing a part of the masking member which is attached to the casting product of the cylinder head. This figure describes a square area among four of the knock pins 32 shown in FIG. 4. As shown in FIG. 5, the masking member 30 comprises a mask portion 30*a* to mask the matching surface with the cylinder block, mask portions 30*b*, 30*c*, 30*d* and 30*e* to mask openings of the intake ports and the exhaust ports, and a mask portion 30*f* to mask a region which is sandwiched between the openings of the exhaust ports 16 and 18 shown in FIG. 2.

The mask portion 30*a* is linked directly to the mask portions 30*b*, 30*c*, 30*d* and 30*e* without any steps, and the mask portion 30*f* is linked directly to both of the mask portions 30*d* and 30*e* without a step. Here, when two mask portions are linked without other mask portions, it is meant that the one mask portion is "linked directly to" the other mask portion. For example, the mask portion 30*a* is linked to the mask portion 30*f* through the mask portion 30*d* or 30*e*, but it is not true that the mask portion 30*a* is linked directly to the mask portion 30*f*. Note that the injector hole 20 is exposed in FIG. 5, where an exclusive masking member being independent of the masking member 30 will be inserted before the step S6 described below.

The mask portion 30*f* shown in FIG. 5 masks a region including a narrow region $A_1$ shown in FIG. 2, whose width being defined by a distance $D_{EX1-EX2}$ between opening edges of the exhaust ports 16 and 18 is the shortest. It is preferable that the mask portion 30*f* masks a necessary minimum area including at least the narrow region $A_1$, since heat shielding performance of a combustion chamber of an engine decreases when the mask portion 30*f* masks large area and the film formation region becomes small.

Figure 6:
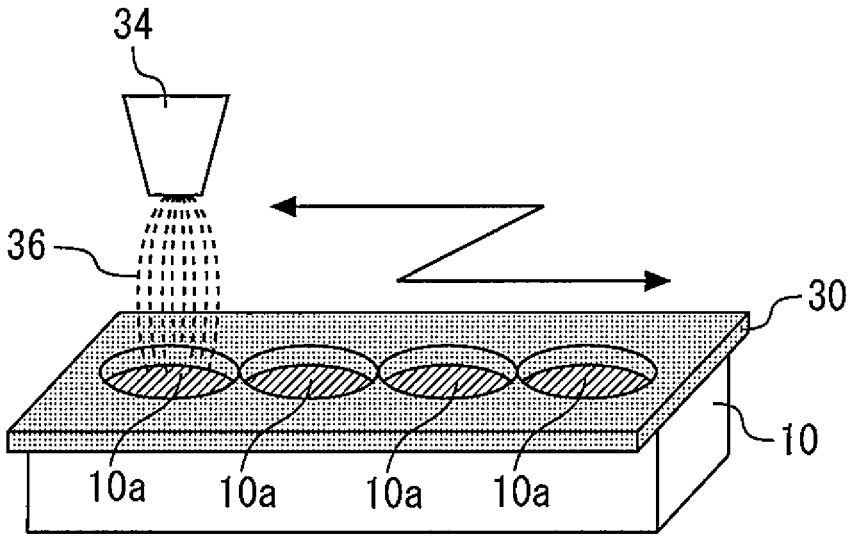
FIG. 6 is a diagram for describing a step S6 of FIG. 1.

Following the step S5, a film formation of the heat shield film is carried out (step S6). This step S6 is described with reference to FIG. 6. Note that the cylinder head material and the masking member are simplified in FIG. 6 for convenience of the explanation. As shown in FIG. 6, film material particles 36 (e.g., chrome-nickel steel-based ceramics particles, zirconia particles, and the like) on a carrier (e.g., plasma jet, compressed air, a fuel gas, an inert gas, and the like) are injected from a nozzle 34 in this step S6. During the injection from the nozzle 34, the nozzle 34 is reciprocated in a longitudinal direction of the cylinder head material 10 while a tip of the nozzle 34 is kept vertical to the surface of the masking member 30 (more properly, the matching surface with the cylinder block 10*b*). In this manner, a heat shield film having a desired thickness depending on heat properties (e.g. 50 to 200 μm) is formed on the wall surface 10*a*. However, the tip of the nozzle 34 does not have to be vertical to the surface of the masking member 30 exactly and may incline to some extent. In this case, it is desirable to keep an injection direction of the film material particles 36 being vertical to the film formation region.

Figure 7:
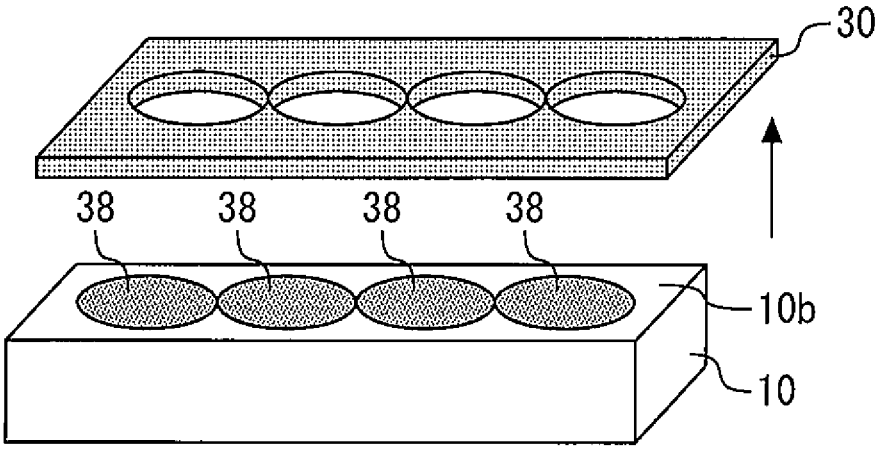
FIG. 7 is a diagram for describing a step S7 of FIG. 1.

Following step S6, a detaching of the masking member 30 is carried out (step S7). This step S7 is described with reference to FIG. 7. Note that the cylinder head material and the masking member are simplified in FIG. 7 for convenience of the explanation. As shown in FIG. 7, the masking member 30 is detached from the cylinder head material 10 on which a heat shield film 38 is formed. Note that before the detachment, the knock pins 32 shown in FIG. 4 are removed from the bolt holes. Also, the exclusive masking member mentioned above is detached from the injector hole before or after the detachment of the masking member 30.

The area of the narrow region $A_1$ shown in FIG. 2 is smaller than areas of the other regions within the wall surface 10*a*. And therefore, if a heat shield film is formed on the narrow region $A_1$, the film has less sticking force therewith. Thus, the heat shield film on the narrow region $A_1$ is easily peeled during detachment of the masking member in the step S7 or during the finish processing in the step S8 discussed below. In this regard, according to the masking member 30 described with FIG. 5, the narrow region $A_1$ is masked by the mask portion 30*f*. That is, film formation on the narrow region $A_1$ where the peeling of the heat shield film tends to take place can be avoided. Therefore, an occurrence of the peeling of the heat shield film and thus, a high-quality heat shield film can be obtained.

Also, in the masking member 30, the mask portions 30*a* to 30*f* are united to a single masking member, which helps to simplify the attachment in the step S4 and the detachment in the step S6. Compared with a case where the mask portion 30*f* is separated from the mask portions 30*a* to 30*e*, the united single masking member makes it possible to save a lot of trouble in the removal of the adhered film material particles. These advantages will help to promote reuse of the masking member 30 and also to enhance productivity of the cylinder head.

Referring back to FIG. 1, a finish processing of the surface of the heat shield film is carried out after the step S7 (step S8). In this step S8, for example, a smoothing of the film surface and adjustment of the film thickness are carried out by a cutting with end mills and the like or a plane grinding with a whetstone. Parallel to this process, a machining of unprocessed portions such as the intake ports which were not processed in the machining of the step S2 and a formation surfaces for seating umbrella portions such as umbrella portions of the intake valves are carried out.

Following the step S8, a final washing of the cylinder head material is carried out (step S9). In the step S8, specifically, washings are injected to the intake port 12, the injector hole 20, the film formation region and the like shown in FIG. 2 and thereby foreign matters such as cut chips generated in the finish processing and the machining described in the step S8 are removed therefrom.

Following the step S9, an inspection of the cylinder head material is carried out (step S10). In the step S9, for example, inspections of the heat shield film and the shapes of the intake ports and the exhaust ports are carried out. After the step S10, the cylinder head which has the heat shield film on the wall surface 10*a* shown in FIG. 2 can be manufactured.

Note that in the first embodiment mentioned above, the intake ports 12 and 14 and the exhaust ports 16 and 18 shown in FIG. 2 correspond to the "port holes" of the present application. The mask portion 30*a* shown in FIG. 2 corresponds to the "matching surface mask portion" of the present application. The mask portions 30*b* to 30*e* shown in FIG. 2 correspond to the "port hole mask portions" of the present application. The mask portion 30*f* shown in FIG. 2 corresponds to the "between openings mask portion" of the present application.

Further, the steps from the step S1 through the step S4 shown in FIG. 1 correspond to the "preparation step" of the present application. The step S5 shown in FIG. 1 corresponds to the "attaching step" of the present application. The step S6 shown in FIG. 1 corresponds to the "film formation step" of the present application. The step S7 shown in FIG. 1 corresponds to the "detaching step" of the present application.

Other Manufacturing Methods for a Cylinder Head

In the first embodiment mentioned above, the region including the narrow region $A_1$ is described, whose width is the shortest distance $D_{EX1-EX2}$ between opening edges of the exhaust ports 16 and 18. However, as shown in FIG. 2, the wall surface 10*a* includes regions sandwiched between openings of the intake ports 12 and 14, between openings of the intake port 12 and the exhaust port 16, and between openings of the intake port 14 and the exhaust port 18 as well as the region sandwiched between the openings of the exhaust ports 16 and 18. Therefore, a masking member 40 shown in FIG. 5 may be used in the step S5.

Figure 8:
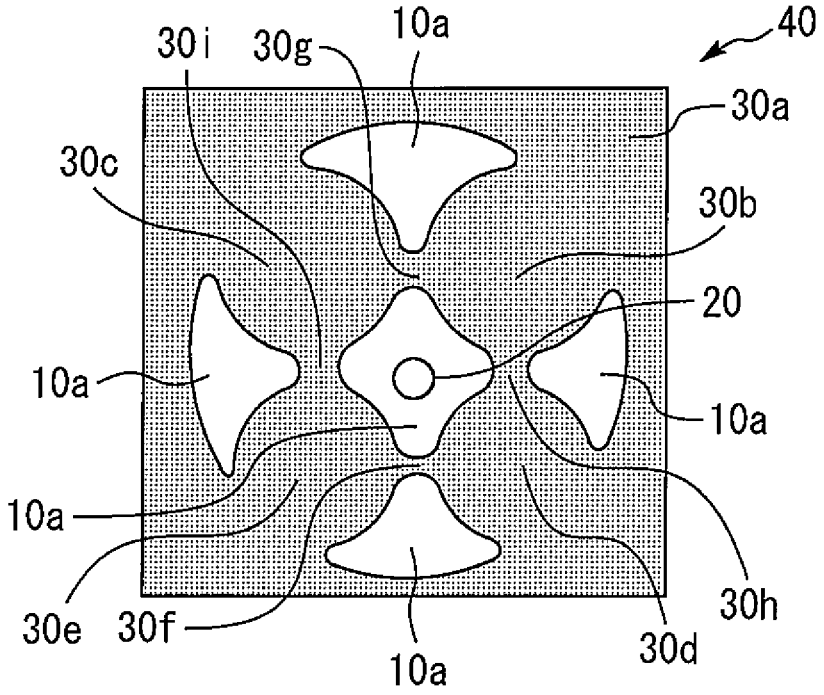
FIG. 8 is a diagram for describing an alternative masking member used in the step S5 of FIG. 1.

FIG. 8 is a diagram for showing a part of an alternative masking member which is attached to the casting product of the cylinder head. A masking member 40 shown in FIG. 8 is configured to mask all regions sandwiched between openings of two adjacent ports. Specifically, the masking member 40 comprises, in addition to the mask portions 30*a* to 30*f* described with FIG. 5, a mask portion 30*g* to mask a region which is sandwiched between the openings of the intake ports 12 and 14 shown in FIG. 2, a mask portion 30*h* to mask a region which is sandwiched between the openings of the intake port 12 and the exhaust port 16, and a mask portion 30*i* to mask a region which is sandwiched between the openings of the intake port 14 and the exhaust port 18.

The mask portions 30*g* to 30*i* have the same basic structure as the mark portion 30*f*. That is, the mask portion 30*g* is linked directly to both of the mask portions 30*b* and 30*c* without a step. The mask portion 30*g* masks a region including a narrow region $A_2$, as shown in FIG. 2, whose width being defined by a distance $D_{IN1-IN2}$ between opening edges of the intake ports 12 and 14 is the shortest. The mask portion 30*h* is linked directly to both of the mask portions 30*b* and 30*d* without a step. The mask portion 30*h* masks a region including a narrow region $A_3$ shown in FIG. 2, whose width being defined by a distance $D_{IM1-EX1}$ between opening edges of the intake port 12 and the exhaust port 16 is the shortest. The mask portion 30*i* is linked directly to both of the mask portions 30*c* and 30*e* without a step. The mask portion 30*i* masks a region including a narrow region $A_4$ shown in FIG. 2, whose width being defined by a distance $D_{IN2-EX2}$ between opening edges of the intake port 14 and the exhaust port 18 is the shortest.

In the first embodiment mentioned above, the masking member is described to mask the non-film formation region of the wall surface of the combustion chamber on which two intake ports and exhaust ports are formed respectively. However, the number of these ports are not limited thereto. For example, three intake ports and exhaust ports may be formed respectively on the combustion chamber. Alternatively, four intake ports and exhaust ports may be formed respectively on the combustion chamber. Alternatively, the number of the intake port may be different from the number of the exhaust port, for example, two intake ports and one exhaust port may be formed on the combustion chamber. In either case, the same effect as the first embodiment can be obtained if a masking member for practical use is selected by considering a narrow region whose width being defined by a distance between opening edges of two adjacent ports among at least three ports is the shortest, restoring balance between the area of the narrow region and heat shielding performance as necessary, and judging whether a mask portion like the mask portion 30*f* described with FIG. 5 should be applied.

For example, the masking member for practical use is selected as follows: dividing the narrow regions $A_1$ to $A_4$ into two groups consisting of a long distance group and a short distance group in accordance with the shortest distance between opening edges of two adjacent port holes among four port holes shown in FIG. 2 (i.e. the distance $D_{EX1-EX2}$, $D_{IN1-IN2}$, $D_{IN1-EX1}$, $D_{IN2-EX2}$), determining to mask at least one region which is divided into the short distance group.

Second Embodiment

A second embodiment of the present application is described with reference to FIGS. 9 and 10.

Note that since a flow of a manufacturing method of the second embodiment is basically the same as that of the first embodiment described with FIG. 1, a description about the flow that overlaps with the first embodiment will be omitted.

Manufacturing Method for a Cylinder Head

A manufacturing method of the second embodiment, a hole for housing a glow plug-integrated cylinder pressure sensor (hereinafter referred to as a "CPS hole") is formed on a predetermined position of the cylinder head material at the machining of the step S2 described with FIG. 1. FIG. 9 is a schematic diagram for showing a region, after the machining of the step S2, to which the wall surface of the combustion chamber corresponds within the surface of the casting product of the cylinder head. As shown in FIG. 9, in addition to the intake ports 12 and 14 and the exhaust ports 16 and 18, a CPS hole 22 is formed on the central part of a surface of a cylinder head material 50 (more properly, the central part of a wall surface of the combustion chamber).

In the manufacturing method of the second embodiment, a masking member comprising a mask portion to mask an opening of the CPS hole is used in the step S5 shown in FIG. 5. FIG. 10 is a diagram for describing a part of the masking member in a state of being attached to the casting product of the cylinder head. This figure describes the square area among four of the knock pins 32 shown in FIG. 4. As shown in FIG. 10, the masking member 60 comprises, in addition to the mask portions 30*a* to 30*e*, a mask portion 30*j* to mask an opening of the CPS hole 22 shown in FIG. 9.

The mask portion 30*j* have the same basic structure as the mark portion 30*g* described with FIG. 8. That is, the mask portion 30*j* is linked directly to both of the mask portions 30*b* and 30*c* without a step. The mask portion 30*j* masks a region including the narrow region $A_2$, as shown in FIG. 2, whose width being defined by the distance $D_{IN1-IN2}$ between opening edges of the intake ports 12 and 14 is the shortest.

Figure 9:
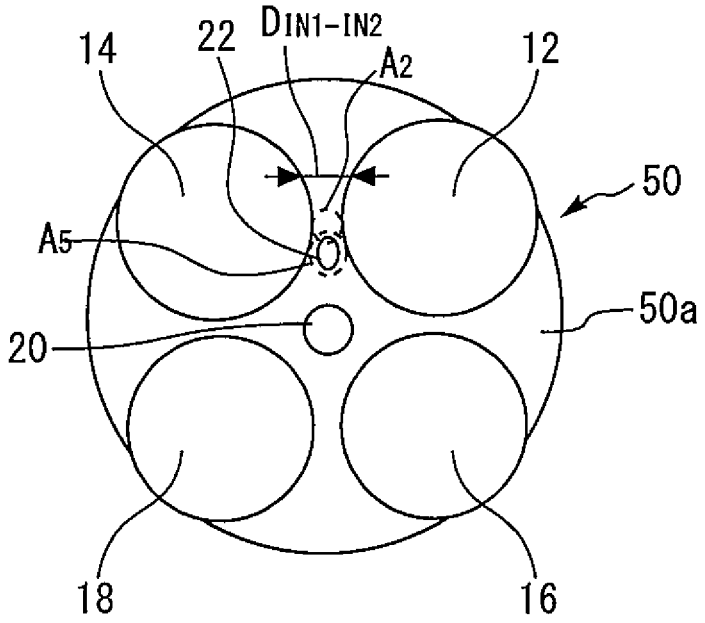
FIG. 9 is a schematic diagram for showing a region, after a machining of a step S2 of FIG. 1, to which a wall surface of a combustion chamber corresponds within a surface of a casting product of a cylinder head.
Figure 10:
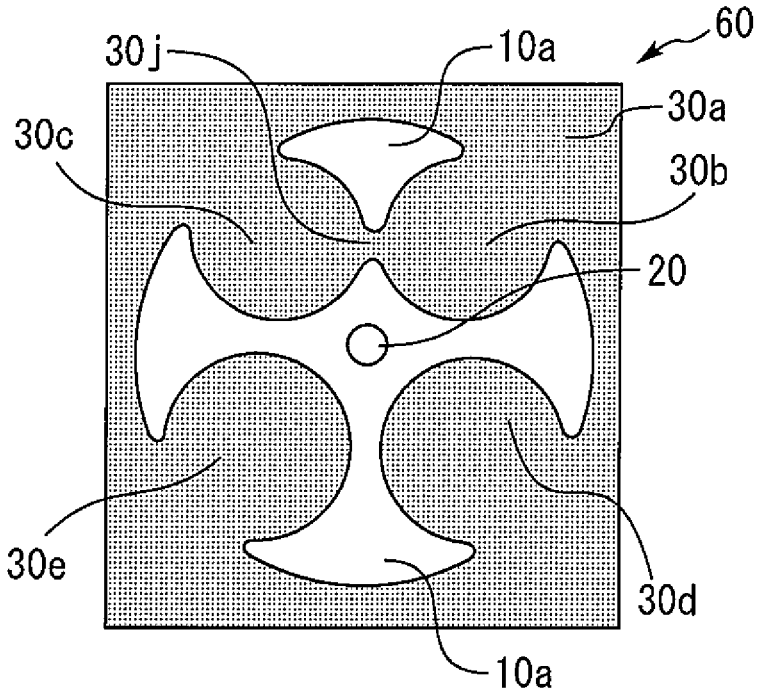
FIG. 10 is a diagram for describing a part of the masking member in a state of being attached to the casting product of the cylinder head.

The mask portion 30*j* shown in FIG. 10 masks both the narrow region $A_2$ shown in FIG. 9 and a CPS region $A_5$ shown in FIG. 9 which is a region including an opening of the CPS hole 22. The CPS region $A_5$ is the closest region to the narrow region $A_2$ among the narrow regions $A_1$ to $A_4$. It is preferable that the mask portion 30*j* masks a necessary minimum area including at least the narrow region $A_2$ and the CPS region $A_5$, since heat shielding performance of a combustion chamber of an engine decreases when the mask portion 30*j* masks large area and the film formation region becomes small.

The area of the narrow region $A_2$ or the CPS region $A_5$ shown in FIG. 9 is smaller than area of the other regions within the wall surface 50*a*. And therefore, if a heat shield film is formed on the narrow region $A_2$ or the CPS region $A_5$, the film has less sticking force therewith. Thus, the heat shield films on these regions $A_2$ and $A_5$ are easily peeled during detachment of the masking member in the step S7 or during the finish processing in the step S8. In this regard, according to the masking member 60 described with FIG. 10, these regions $A_2$ and $A_5$ are masked by the mask portion 30*j*. That is, film formation on the narrow region $A_1$ or the CPS region $A_5$, where the peeling of the heat shield film tends to take place can be avoided. Therefore, an occurrence of the peeling of the heat shield film and thus, a high-quality heat shield film can be obtained.

Note that in the second embodiment mentioned above, the CPS hold 22 shown in FIG. 9 corresponds to the "part hole" of the present application.

Other Manufacturing Methods for a Cylinder Head

In the second embodiment mentioned above, the glow plug-integrated cylinder pressure sensor is housed in the cylinder head. However, a glow plug and a cylinder pressure sensor may be separately housed in the cylinder head. In this case, a hole for housing the glow plug and a hole for housing the cylinder pressure sensor may be formed separately on each region sandwiched between openings of two adjacent ports among the intake ports and the exhaust ports. Therefore, the same effect as the second embodiment can be obtained if a masking member comprising a mask portion to mask the opening of the hole for housing the glow plug and a mask portion to mask the opening of the hole for the cylinder pressure sensor and two mask portions, both of which is linked directly to two mask portions located both side of the hole for housing the glow plug or the cylinder pressure sensor is used.

In the second embodiment mentioned above, the cylinder head is described as a cylinder head for a compression self-ignition type engine. However, the cylinder head may be a cylinder head for a spark ignition type engine. In the spark ignition type engine, a spark plug is housed in the cylinder head substitute for the glow plug-integrated cylinder pressure sensor. The spark plug is generally housed on the center portion of the wall surface of the combustion chamber (i.e. the position of the injector hole 20 shown in FIG. 9). When two spark plugs are housed, however, one of the spark plugs may be housed in a hole between the two intake ports like the glow plug-integrated cylinder pressure sensor mentioned above. In this case, the same effect as the second embodiment can be obtained if a masking member comprising a mask portion to mask an opening of the hole for housing the one of the spark plugs which is linked directly to the mask portions to mask the intake ports is used.

What is claimed is:

1. A manufacturing method for a cylinder head comprising the steps of:

preparing a cylinder head material having a cylinder block matching surface with a cylinder block and an inner wall surface of an engine combustion chamber in a same plane, wherein at least three port holes corresponding to at least one intake port and at least one exhaust port are formed on the inner wall surface;

attaching the cylinder head material to a masking member to mask a non-film formation region of the inner wall surface and the cylinder block matching surface;

after the attachment of the masking member, injecting film material particles through the masking member onto the inner wall surface of the engine combustion chamber to form a heat shield film; and detaching the masking member from the cylinder head material after the formation of the heat shield film, wherein the masking member comprises:

a matching surface mask portion that masks the matching surface with the cylinder block; port hole mask portions that are connected to the matching surface mask portion directly and mask openings of the at least three port holes; and a between openings mask portion that masks at least one narrow region which is sandwiched between openings of two adjacent port holes of the at least three port holes and has the shortest distance between opening edges of the two adjacent port holes of the at least three port holes, and is directly connected to both of the port hole mask portions that mask the openings of the adjacent port holes of the at least three port holes, and wherein the matching surface mask portion, the port hole mask portions and the between openings mask portion are coplanar.

2. The manufacturing method for a cylinder head according to claim 1, wherein the inner wall surface further includes a part hole that is a hole for housing an engine-related part, the between openings mask portion masks an opening of the part hole.

3. The manufacturing method for a cylinder head according to claim 2, wherein the between openings mask portion masks a region including the opening of the part hole and one of the at least one narrow region which is the closest to the opening of the part hole.

4. The manufacturing method for a cylinder head according to claim 1, wherein the film material particles are sprayed onto the entire region of the inner wall surface in a direction opposed to the matching surface with the cylinder block.

5. The manufacturing method for a cylinder head according to claim 1, wherein the at least one narrow region comprises a plurality of narrow regions which are divided into two groups in accordance with the shortest distance between the opening edges of the two adjacent port holes of the at least three port holes, and the between openings mask portion masks at least one region that is divided into a short distance group.

6. The manufacturing method for a cylinder head according to claim 1, wherein the inner wall surface includes at least two openings of two adjacent intake ports of the at least three port holes, and the between openings mask portion masks at least one region within the at least one narrow region, wherein the at least one region is a sandwiched region between the at least two openings of the adjacent intake ports.

7. The manufacturing method for a cylinder head according to claim 1, wherein the inner wall surface includes at least two adjacent exhaust ports, and the between openings mask portion masks at least one region within the at least one narrow region, and wherein the at least one region is a sandwiched region between the openings of the adjacent exhaust ports.

8. The manufacturing method for a cylinder head according to claim 1, wherein the at least one narrow region comprises a plurality of narrow regions, the between openings mask portion masks the plurality of narrow regions.

* * * * *